US006322107B1

(12) United States Patent
Lieberman

(10) Patent No.: US 6,322,107 B1
(45) Date of Patent: Nov. 27, 2001

(54) INFLATABLE CALENDAR

(75) Inventor: Marvin S. Lieberman, New York, NY (US)

(73) Assignee: Alvimar Manufacturing Co., Inc., Long Island City, NY (US)

( * ) Notice: Subject to any disclaimer, the term of this patent is extended or adjusted under 35 U.S.C. 154(b) by 0 days.

(21) Appl. No.: 09/440,959

(22) Filed: Nov. 16, 1999

(51) Int. Cl.[7] ..... B42D 5/04

(52) U.S. Cl. ..... 283/2; 283/3; 283/4; 40/107; 40/736

(58) Field of Search ..... 283/2–4; 446/220, 446/224; 40/207, 358, 720, 736, 610, 107

(56) References Cited

U.S. PATENT DOCUMENTS 237,584 * 2/1881 Ogle ..... 40/107
2,797,512 * 7/1957 Sieve ..... 40/107
3,001,307 * 9/1961 Sieve ..... 40/107
4,409,750 * 10/1983 Silbermintz ..... 40/107
4,458,433 * 7/1984 Breeze ..... 40/107
5,251,908 * 10/1993 Myers ..... 273/428
5,662,509 * 9/1997 Lieberman ..... 446/220

* cited by examiner

*Primary Examiner*—Willmon Fridie, Jr.
(74) *Attorney, Agent, or Firm*—Steinberg & Raskin, P.C.

(57) ABSTRACT

An inflatable calendar formed of thin flexible plastic sheet defining when inflated a fourteen-sided polyhedron enclosure comprising opposite top and bottom hexagonal walls and six consecutive trapezoidal upper side walls extending downward from said top wall and six consecutive trapezoidal lower side walls extending upward from said bottom wall, the mutually adjacent edges of all mutually adjacent walls being sealed together, said polyhedron enclosure further comprising a valve for inflating, deflating or maintaining inflated said enclosure, and graphic indicia on said six upper and lower side walls respectively displaying the twelve months of a selected year, where each side wall displays the days of one month.

9 Claims, 5 Drawing Sheets

FIG. 3
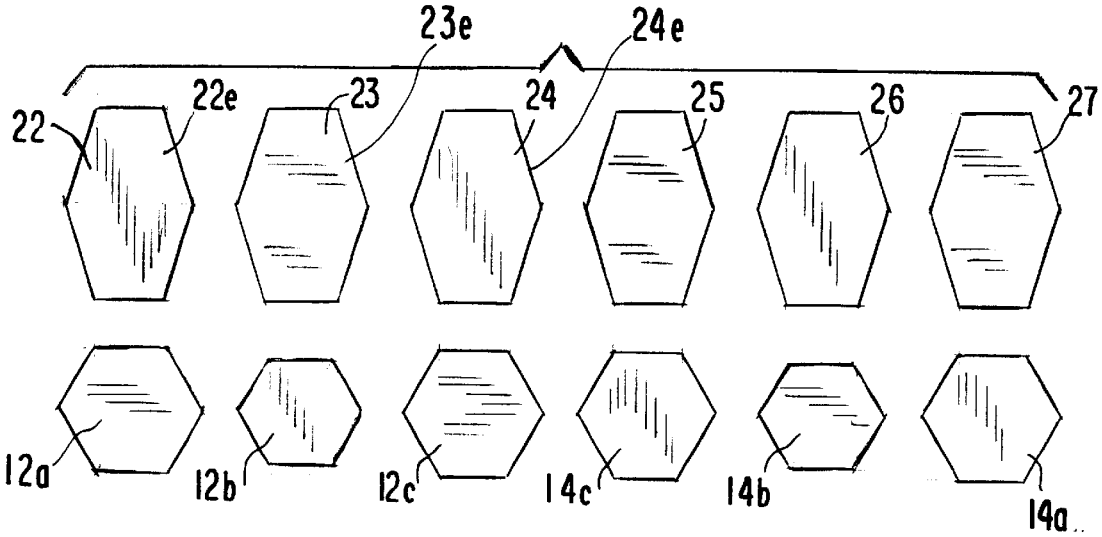
FIG. 4
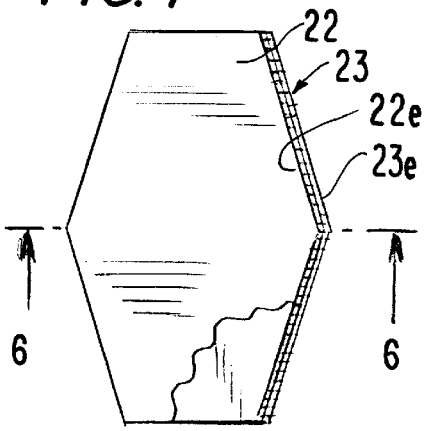
FIG. 5
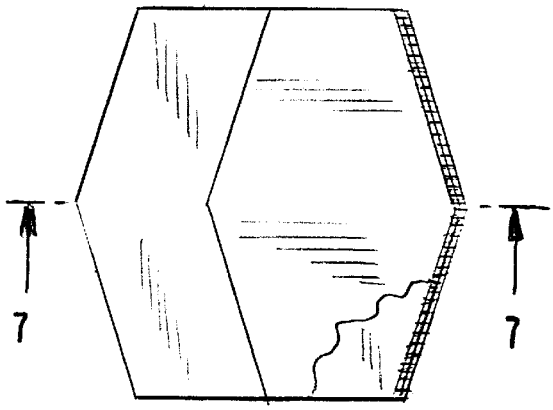
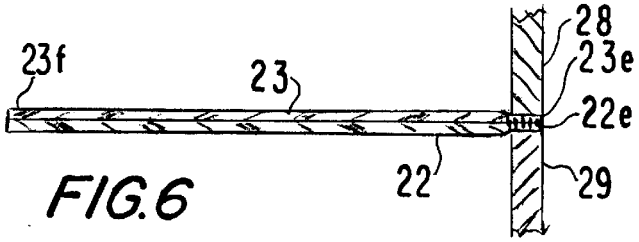
FIG. 6
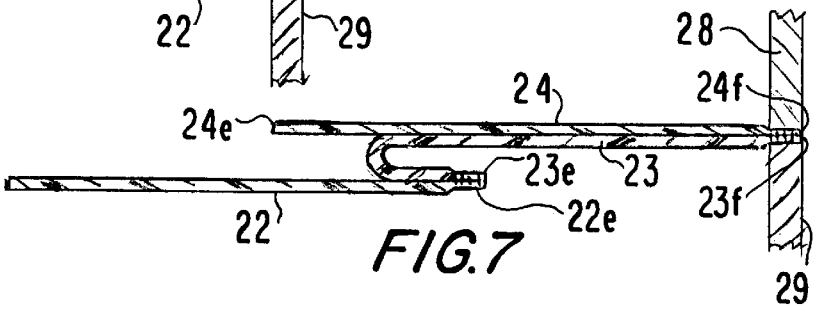
FIG. 7

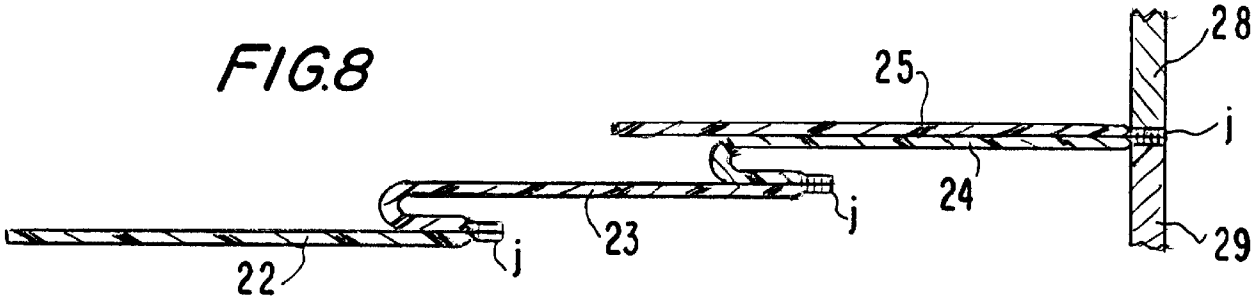
FIG.8
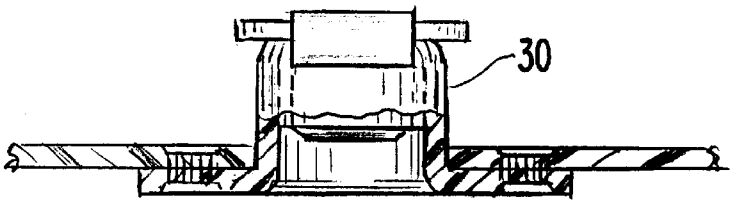
FIG. 10
FIG.9
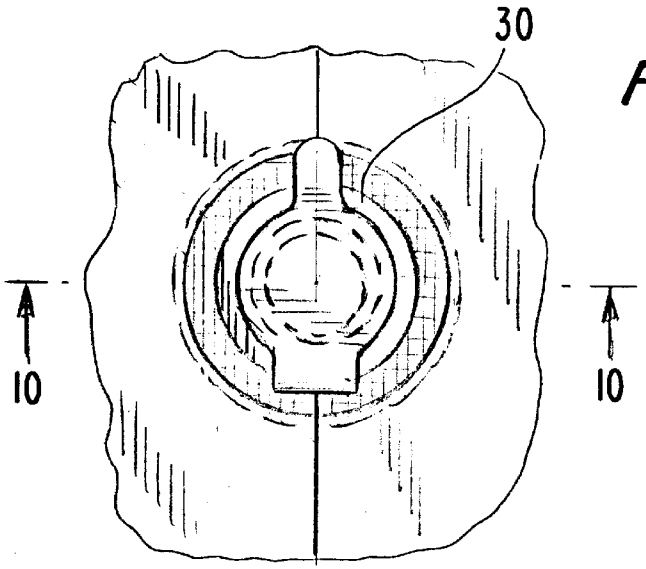

FIG.12
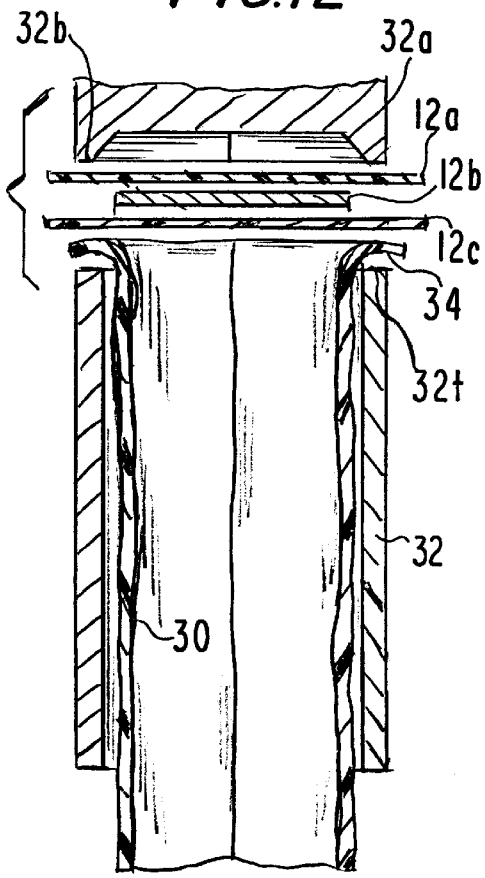
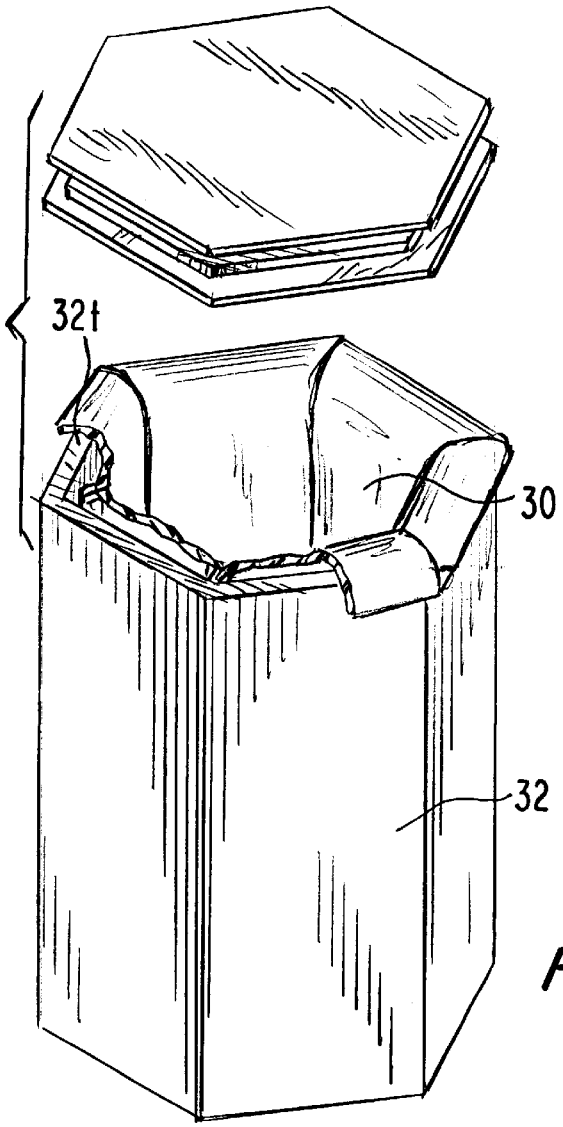
FIG. 12A

INFLATABLE CALENDAR

BACKGROUND OF THE INVENTION

1. Field of the Invention

This invention is in the field of calendars, and desk accessories and inflatable articles and particularly three-dimensional or sculptural calendars.

2. Prior Art

Prior art calendars are obviously primarily two-dimensional sheets of paper or plastic. One example of a three-dimensional calendar is a rigid ceramic cup on which the months and days are printed or painted around the circumferential surface. Another three-dimensional calendar is made of unfoldable cardboard which forms generally a six-sided cylinder with indicia for two months printed on each of the six sides. Optionally, six months appear upright on six successive sides when the cylinder is upright; on reversing the cylinder to upside down state, the remaining six months appear upright on successive six sides. A further variation is a fourteen sided unfoldable cardboard polyhedron having the top and bottom ends and twelve side surfaces for the calendar months. These twelve surfaces are inclined from vertical for easier viewing.

SUMMARY OF THE INVENTION

The new invention provides a calendar in the shape of a fourteen sided polyhedron in a new medium, namely inflatable plastic sheet. It is novel, amusing and attractive. Also it is substantially inexpensive to make, package and ship and is even deflatable and reinflatable if desired. It also functions as a toy or an object to be thrown and caught or bounced. It is highly suitable as a promotional or advertising medium because selected graphics can be easily and inexpensively applied to the exposed surfaces. While the overall shape has been utilized before, this invention is novelty in the selected medium, structure and mode of construction.

BRIEF DESCRIPTION OF THE DRAWINGS

FIG. 3 is a plan view of the component parts of the inflatable calendar of FIG. 1.

FIG. 4 shows schematically heat sealing step 1 in the assembly of the component parts of FIG. 3.

FIG. 5 shows schematically heat sealing step 2 of said assembly.

FIG. 6 is a fragmentary sectional view taken along line 6—6 of FIG. 4.

FIG. 7 is a fragmentary sectional view taken along line 7—7 of FIG. 4.

FIG. 8 is a fragmentary section view showing heat sealing step 3 for joining the third sheet in the assembly.

FIG. 9 is a fragmentary plan view of the valve.

FIG. 10 is a partial section view taken along lines 10—10 in FIG. 9.

FIG. 12 is a partial perspective view showing a die, the assembled side sheets formed into a cylinder which is situated in the die, and the top wall components positioned to be heat sealed to the top edges of said sides.

FIG. 12A is a partial sectional view of the die and parts to be heat sealed seen in FIG. 12.

DETAILED DESCRIPTION OF THE PREFERRED EMBODIMENT

A. Description of Assembled Calendar

Figure 1:
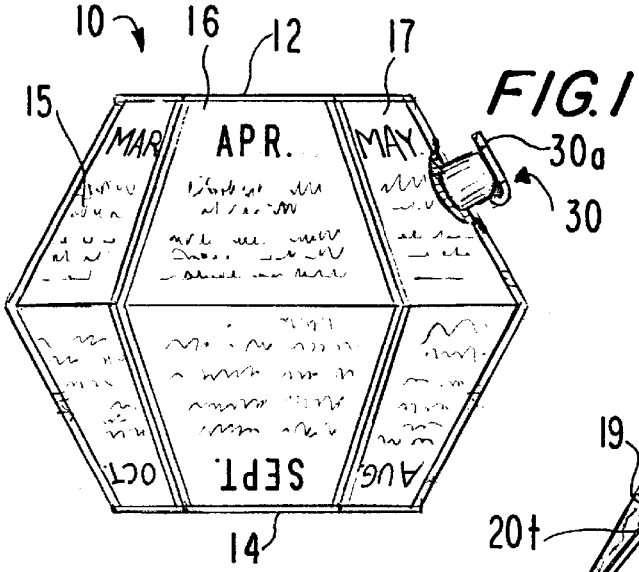
FIG. 1 is a front elevation view of the new inflatable calendar.
Figure 2:
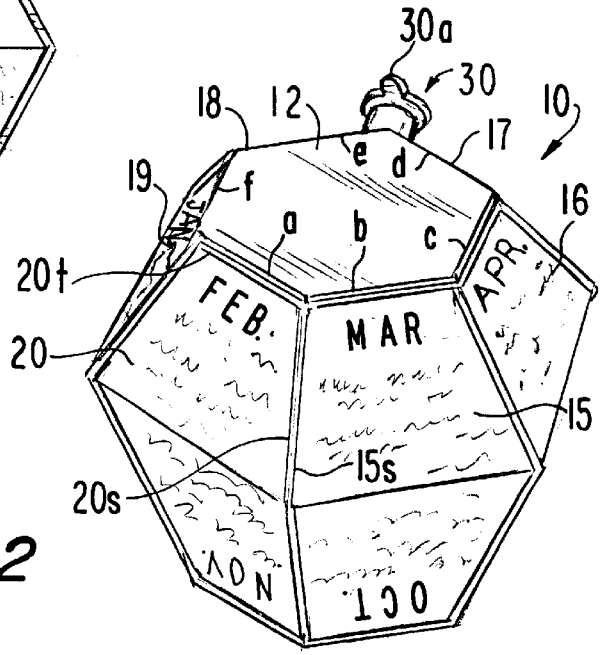
FIG. 2 is a top front perspective view of FIG. 1.

FIGS. 1 and 2 show the new inflatable calendar 10 in inflated condition. This calendar as shown is a fourteen sided polyhedron enclosure comprising hexogonical top wall 12, hexogonical bottom wall 14, trapezoidal upper walls 15–20, trapezoidal lower walls 21–27, and valve 30. The top wall and upper trapezoidal walls define an upper canopy with adjacent side edges heat sealed together; the bottom wall and lower trapezoidal walls defining a similar lower canopy, upside down and opposite said upper canopy. For the purpose of explaining this invention the side walls have been described as twelve separate trapezoidal shapes; however, in preferred practice and as illustrated in the drawings herein, each set of adjacent upper and lower trapezoidal walls is formed of a single sheet for simplifying construction and improving appearance.

Said hexogonal top wall 12 has six edges a–f as seen in FIG. 2. The top edge 20T of top wall 20, for example, is secured to edge a of top wall 12. The other edges b–f of top wall 12 are similarly secured to adjacent upper walls. Each two adjacent upper side walls have their respective adjacent edges joined together. The lower side walls are similarly joined. Also, the bottom hexogonal wall 14 is joined similarly as the top hexogonal wall. As noted above, the present drawings show each upper side wall being an extension of and contiguous with an adjacent bottom side wall, thus defining a simple sheet.

Each of said side walls is formed of a single layer of plastic sheet, whether formed of upper and lower parts or as a single element. The top and bottom walls differ from said side walls in that each is a laminate of two of said sheets of plastic with a sheet of cardboard between the plastic sheets to result in relatively stiff top and bottom surfaces 12 and 14 of the polyhedron. This will stabilize the calendar to sit erect when placed with said top or bottom wall on a flat surface such as a table top.

The side walls include their graphic indicia each showing one of the twelve calendar months. As shown in part in FIGS. 1 and 2, the months January through June appear on six adjacent upper walls, and the months July through December appear upside down on the six adjacent lower walls. For example, March, April and May in FIG. 1 are designated upper sides 15, 16 and 17. Obviously, when this calendar is inverted to place the top wall is down on a table surface, the bottom wall 14 becomes the top and the lower walls are now oriented upright. It is further obvious that mere rotation of the calendar will expose about three of the upper and lower month walls at any time, with the month in the position of the most centered upper wall being the most visible, that wall being designated April in FIG. 1.

The valve 30 is a standard element common to prior art inflatable articles. It may be a simple tube with an insertable plug 30A, or it may further include an internal flap valve (not shown) that resists deflation unless the valve tube is squeezed radially inward to displace the internal flap from blocking air flow.

The mode of assembly of this inflatable calendar is also novel, to achieve an attractive and economical product. The components of the assembly are shown in FIG. 3 with the top wall 12 formed by the laminate or sandwich of outer sheet 12A, cardboard insert 12B and inner sheet 12C. The bottom wall 14 is similar with outer sheet 14A, cardboard insert 14B and inner sheet 14C.

As discussed above, while FIGS. 1 and 2 show the inflatable calendar as having six upper and six lower side walls, the preferred assembly forms these twelve side wall elements of six sheets, each comprising one upper and one adjacent lower wall. This simplifies construction, improves appearance, and reduces cost. Accordingly, as seen in FIG. 3, there are six upper-lower combination walls 22–27 now called side walls.

B. Description of Method Manufacture

First two side walls 22, 23 are placed in overlying relationship as seen in FIG. 4, and their adjacent edges 22E, 23E are heat scaled together from top to bottom along one side as seen in FIG. 6 by heat scaler jaws 28 and 29.

Figure 11:
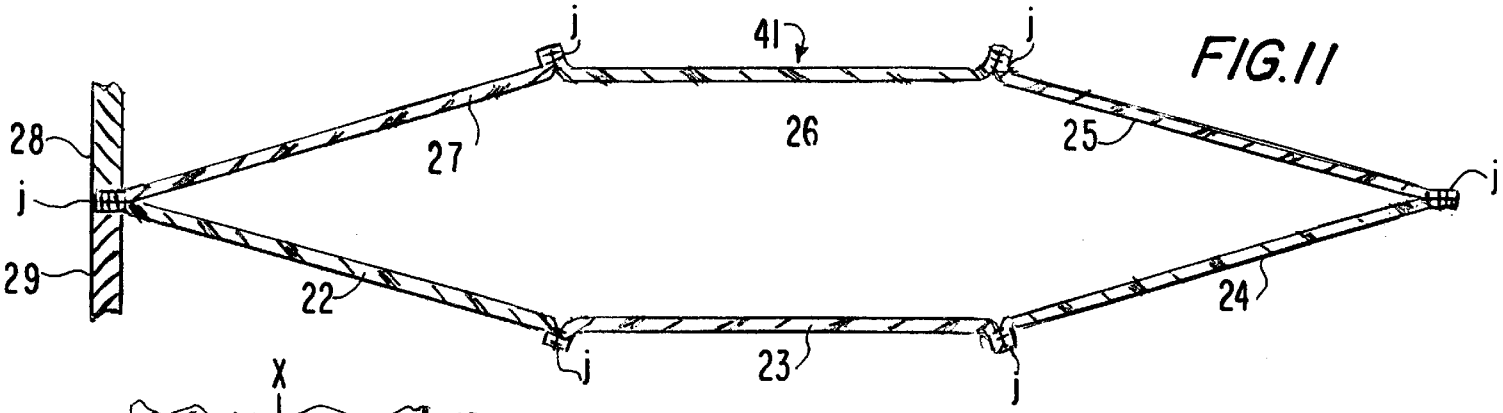
FIG. 11 is a section view showing heat sealing step 6 for joining the sixth sheet in the assembly.

Next, as seen in FIG. 5 sidewall 23 of the joined walls 22 and 23 is placed to overlie wall 24, and their adjacent edges are heat sealed as seen in FIG. 7. This is repeated, as seen in FIG. 8 where sidewall 24 of the three joined walls is placed to overlie wall 25, and they are heat sealed. This is repeated two more times until a six sided cylinder is formed with six seams or junctions where their mutual edges join as indicated in FIG. 11. In one of these junctions the valve 30 is situated and heat sealed in a manner common in the prior art and as seen in FIGS. 9 and 10, where 30A is the cap and air sealing insert.

Next, as seen in FIGS. 12, 12A and 13–15, this six-sided cylinder 30 of soft flexible plastic sheet is placed within a rigid cylindrical die 32 which has top hexogonal edge 32T. The top peripheral edge 34 of the soft plastic cylinder 32 is positioned to extend transversely and overlie die edge 32T. The top wall as described earlier is a laminate of lower soft plastic sheet 12C, relatively stiff cardboard 12B and upper or outer soft plastic sheet 12A, all defining a hexagon to conform to the top peripheral edge of the six-sided cylinder to which the top wall is to be heat sealed.

The cardboard sheet 12B has dimensions slightly less in diameter than the plastic sheets 12C and 12A below and above it. Then as seen in FIG. 12 the upper die 32A is moved downward until its heat sealing edge 32B presses and heats together the peripheral edges of sheets 12C, 12A and 34.

Figure 15:
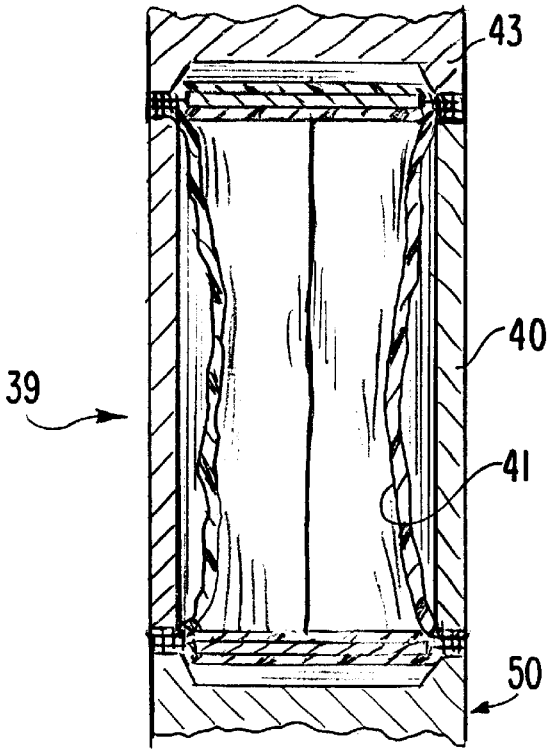
FIG. 15 is similar to FIG. 13 showing the heat sealing of the bottom wall to the assembly.
Figure 14:
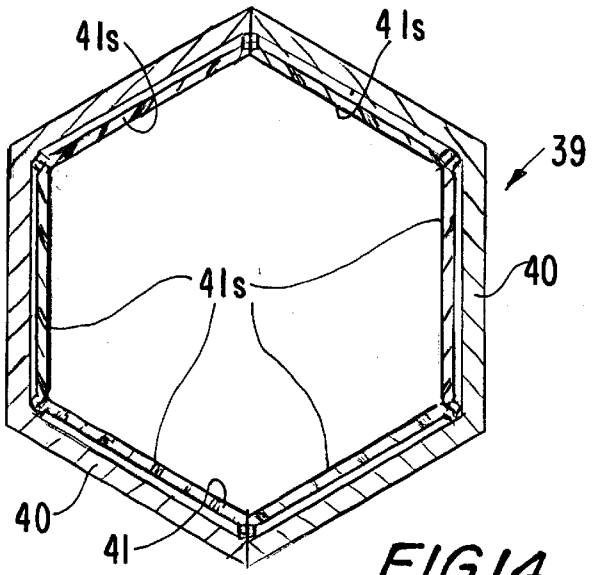
FIG. 14 is a schematic partial plan view taken along lines 14—14 in FIG. 13.
Figure 13:
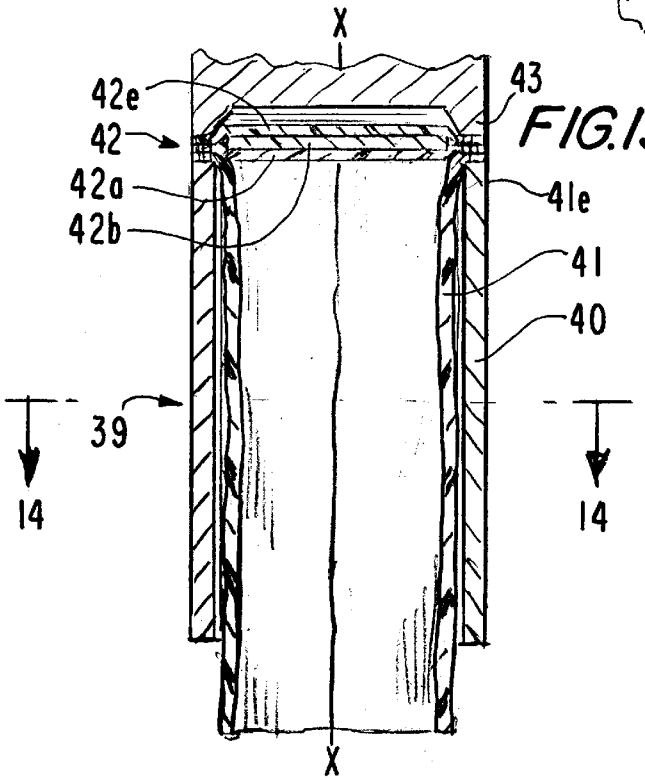
FIG. 13 is a schematic partial elevation view showing another embodiment of a die, jig or fixture for the heat sealing operation of FIG. 12.

FIGS. 13, 14 and 15 show schematically a variation of a die, jig or fixture 39 combined with a heat sealer, as compared to that of FIGS. 12 and 12A. In FIG. 13 the soft plastic article 41 from FIG. 11 is positioned withing the walls 40 of the die, and the top end 41E is heat sealed to the top wall formed by laminate 42 comprising bottom vinyl sheet 42A, cardboard insert 42B and top or outer vinyl sheet 42C (corresponding to sheets 12C, 12B and 12C in FIG. 12). The peripheral edges of sheets 42A and 42C and the edge 41E of the calender enclosure 41 are heat sealed together by the heat sealer jaws 43.

The final heat scaling step is shown in FIG. 15 where the bottom wall laminate 50 is constructed and heat sealed to close the enclosure similarly as the top wall was added. In FIG. 15 the parts have the same reference numbers as in FIG. 14, namely die walls 40, vinyl sheet enclosure walls 41S, and heat sealer jaws 43.

Instead of having the sealer aperture at the top and bottom of the die, there could be a single heat sealer with the die being flipped to seal the top end and then the bottom end, or the vinyl cylinder could be flipped with the fixture, but these variations would be far less efficient for high speed production.

In a further variation the die could be made of two or more parts separable about the central longitudinal axes of the die X—X seen in FIG. 13, which would allow easier removal of the assembled article.

Referring to FIGS. 8 and 11, it can be seen that the heat sealed junctions J are external protrusions. Prior to insertion of the sub-assembly of FIG. 11 into the die or fixture for attachment of the hexogonal top and bottom walls, the sub-assembly can be turned inside out so that these junctions extend inward, thus resulting in a smoother outer surface appearance.

Prior to any of this assembly the graphic indicia for the twelve calendar months would be imprinted onto the side wall components, and optionally other graphics would be imprinted on the top and/or bottom walls. As earlier described, it is preferable for the month-date graphics to be oriented on the side walls so that the first six months are on the upper walls arranged sequentially and the second six moths on the lower walls oriented sequentially and inverted. Obviously, the month-date graphics could be arranged in any order.

The embodiments described above of the inflatable calendar and method of making same are the preferred embodiments; however, variations are possible within the scope and spirit of this invention as defined by the appended claims.

What is claimed is:

1. An inflatable calendar formed of thin flexible plastic sheet defining when inflated a fourteen-sided polyhedron enclosure comprising (a) opposite top and bottom hexagonal walls, each of which has six peripheral edges, (b) six consecutive trapezoidal upper side walls each having its shortest edge sealed to one of said peripheral edges of said top hexagonal wall and extending downward from said top wall, and (c) six consecutive trapezoidal lower side walls each having its shortest edge sealed to one of said peripheral edges of said bottom hexagonal wall and extending upward from said bottom wall, each of said side walls having a pair of opposite side edges, each of said side edges of one side wall being sealed to a side edge of the side wall adjacent thereto, each of said top and bottom side walls having a base edge opposite its shortest edge, each top side wall base edge being adjacent and sealed to the base edge of one bottom side wall, the mutually adjacent edges of all mutually adjacent walls being sealed together, said polyhedron enclosure further compromising a valve for inflating, deflating and maintaining inflated said enclosure, and graphic indicia on said six upper and lower side walls respectively displaying the twelve months of a selected year, where each side wall displays the days of one month. wherein said top wall comprises a laminate of two hexogonal sheets of said plastic sheet and a hexogonal sheet of cardboard between said two plastic sheets for stiffening same.

2. An inflatable calendar formed of thin flexible plastic sheet defining when inflated a fourteen-sided polyhedron enclosure comprising opposite top and bottom hexogonal walls and six consecutive trapezoidal upper side walls extending downward from said top wall and six consecutive trapezoidal lower side walls extending upward form said bottom wall, the mutually adjacent edges of all mutually adjacent walls being sealed together, said polyhedron enclosure further comprising a valve for inflating, deflating or maintaining inflated said enclosure, and graphic indicia on said six upper and lower side walls respectively displaying the twelve months of a selected year, where each side wall displays the days of one month, wherein said top wall has six edges, and each of said trapezoidal upper side walls has four edges comprising a top edge which is shortest, an opposite bottom edge which is largest and opposite side edges, each of said upper walls having its top edge joined to one of said top walls edges, and said bottom wall and said lower side walls having structure essentially the same as said top wall and upper side walls but inverted, and each set of said adjacent upper and lower side walls having their mutually adjacent longest edges joined, and wherein each of said sets of adjacent upper and lower side walls is formed of a single six-sided plastic sheet, and wherein said top wall comprises a laminate of two hexogonal sheets of said plastic and a hexogonal sheet of cardboard between said two plastic sheets for stiffening same.

3. An inflatable calendar according to claim 1 wherein each of said mutually adjacent edges is a heat sealed junction.

4. An inflatable calendar according to claim 1 wherein said upper site walls indica display the months January, February, March, April, May and June, all oriented upright, and said lower side walls indica display the months July, August, September, October, November and December, all oriented upside down.

5. An inflatable calendar formed of thin flexible plastic sheet defining when inflated a fourteen-sided polyhedron enclosure comprising (a) opposite top and bottom hexagonal walls, each of which has six peripheral edges, (b) six consecutive trapezoidal upper side walls each having its shortest edge sealed to one of said peripheral edges of said top hexagonal wall and extending downward from said top wall, and (c) six consecutive trapezoidal lower side walls each having its shortest edge sealed to one of said peripheral edges of said bottom hexagonal wall and extending upward from said bottom wall, each of said side walls having a pair of opposite side edges, each of said edges of one side wall being sealed to a side edge of the side wall adjacent thereto, each of said top and bottom side walls having a base edge opposite its shortest edge, each top side wall base edge being adjacent and sealed to the bass edge of one bottom side wall, the mutually adjacent edges of all mutually adjacent walls being sealed together, said polyhedron enclosure further comprising a valve for inflating, deflating or maintaining inflated said enclosure, and graphic indicia on said six upper and lower side walls respectively displaying the twelve months of a selected year, where each side wall displays the days of one month wherein each of said mutually adjacent edges is a heat sealed junction.

6. An inflatable calendar according to claim 5 wherein said top wall has six edges, and each of said trapezoidal upper side walls has four edges comprising a top edge which is shortest, an opposite bottom edge which is largest and opposite side edges, each of said upper walls having its top edge joined to one of said top wall edges, and said bottom wall and said lower side walls having structure essentially the same as said top wall and upper side walls but inverted, and each set of said adjacent upper and lower side walls having their mutually adjacent longest edges are joined.

7. An inflatable calendar according to claim 6 wherein said polyhedron enclosure has a central longitudinal axis extending perpendicularly through said top and bottom walls, and each of said trapezoidal upper side walls is inclined with its longest edge farther outward from said central axes than its shortest edge.

8. An inflatable calendar according to claim 6 wherein each of said sets of adjacent upper and lower side walls is formed of a single six-sided plastic sheet.

9. An inflatable calendar formed of thin flexible plastic sheet defining when inflated a fourteen-sided polyhedron enclosure comprising opposite top and bottom hexagonal walls and six consecutive trapezoidal upper side walls extending downward from said top wall and six consecutive trapezoidal lower side walls extending upward from said bottom wall, the mutually adjacent edges of all mutually adjacent walls being sealed together, said polyhedron enclosure further comprising a valve for inflating, deflating or maintaining inflated said enclosure, and graphic indicia on said six upper and lower side walls respectively displaying the twelve months of a selected year, where each side wall displays the days of one month, and wherein said top wall comprises a laminate of two hexogonical sheets of said plastic sheet and a hexogonical sheet of cardboard between said two plastics sheets for stiffening same wherein each of said mutually adjacent edges is a heat sealed junction.

* * * * *